United States Patent [19]

Mardix et al.

[11] Patent Number: 4,934,292

[45] Date of Patent: Jun. 19, 1990

[54] SEWING APPARATUS INCLUDING AN ARRANGEMENT FOR AUTOMATICALLY MONITORING THE BOBBIN THREAD, AND A BOBBON PARTICULARLY USEFUL IN SUCH APPARATUS

[76] Inventors: Bar-Cochva Mardix, 39/B Harechasim St., Ramat Gan; Yaacov Sadeh, 11/6 Bialik Street, Nes Ziona; Yaacov Makover, Moshav Beit Elazari, Moshav Beit Elazari, all of Israel

[21] Appl. No.: 235,147

[22] Filed: Aug. 23, 1988

[51] Int. Cl.[5] ..... D05B 69/36

[52] U.S. Cl. ..... 112/273

[58] Field of Search ..... 112/273, 278, 275, 277, 112/228, 231; 200/61.18

[56] References Cited

U.S. PATENT DOCUMENTS

| | | | |
|---|---|---|---|
| 3,352,267 | 11/1967 | Brandriff et al. | 112/278 |
| 3,738,296 | 6/1973 | MacKenzie et al. | 112/273 |
| 3,843,883 | 10/1974 | DeVita et al. | 112/273 X |
| 4,192,243 | 3/1980 | Blessing et al. | 112/273 |
| 4,569,298 | 2/1986 | Lindh | 112/273 X |
| 4,732,098 | 3/1988 | Mertel et al. | 112/273 X |

*Primary Examiner*—Peter Nerbun

*Attorney, Agent, or Firm*—Benjamin J. Barish

[57] ABSTRACT

A sewing machine bobbin comprises an end wall having an outer face formed with a plurality of radially-extending strips of an optically-sensible material radiating from its center, providing sensible markings enabling the optical detection of the non-rotation of the bobbin during a sewing operation indicating a break in, or the exhaustion of, the thread wound on the bobbin.

16 Claims, 3 Drawing Sheets

SEWING APPARATUS INCLUDING AN ARRANGEMENT FOR AUTOMATICALLY MONITORING THE BOBBIN THREAD, AND A BOBBON PARTICULARLY USEFUL IN SUCH APPARATUS

BACKGROUND OF THE INVENTION

The present invention relates to sewing apparatus including an arrangement for automatically monitoring the bobbin thread, and also to a bobbin particularly useful in such apparatus.

The known sewing machines are provided with various means for feeding an upper thread to the sewing needle, and other means, including a bobbin, for feeding the lower thread to the sewing needle. Monitoring the condition, particularly breakage, of the upper thread is relatively simple, and several methods are in use today, as described for example in U.S. Pat. No. 3,843,883. However, monitoring the condition of the lower bobbin thread is somewhat more problematical, and although a number of systems have been devised for doing this, the known systems are still not entirely satisfactory. The main reason for this is because of the complexity of the path of the lower thread out of the bobbin, which enables very little room for detection. Various methods for detecting an empty bobbin condition using a light beam are known, for example as described in U.S. Pats. No. 4,237,807 and 4,212,257, and in British Patents No. 1,335,677 and 2,078,798. However, these known techniques are usually of complicated construction and generally do not detect all the conditions of the bobbin thread, including thread exhaustion and thread breakage.

Further, the known sewing machines commonly include various devices for maintaining the thread relatively tight on the bobbin, but the arrangements used are also generally of complicated construction.

BRIEF SUMMARY OF THE INVENTION

An object of the present invention is to provide sewing apparatus including an arrangement for automatically monitoring the feeding of the bobbin thread. Another object of the invention is to provide sewing apparatus including an arrangement for maintaining the thread relatively tight on the bobbin. A further object of the invention is to provide a bobbin particularly useful in the above apparatus, and a still further object is to provide a bobbin which, upon thread exhaustion, facilitates rewinding of the thread thereon.

According to one feature of the present invention, there is provided a sewing machine bobbin comprising a pair of end walls interconnected at their centers by an axle for receiving the thread wound on the axle; characterized in that the outer face of one of the end walls is formed with a plurality of radially-extending strips of an optically-sensible material radiating from the center of the end wall and providing sensible markings enabling the optical detection of the non-rotation of the bobbin during a sewing operation. Each of the radially-extending strips of optically-sensible material has a width in the circumferential direction which is a small fraction of its length in the radial direction.

The apparatus further includes an optical sensor for optically sensing the radially-extending strips and for producing a train of pulses during the rotation of the bobbin, such that the termination of the train of pulses by the non-rotation of the bobbin indicates a break in, or the exhaustion of, the thread wound on the bobbin.

According to another feature, the radially-extending strips are offset from the plane of the bobbin end wall to define a plurality of radially-extending vanes for impingement by an air jet from a nozzle oriented to apply a rotary force to the bobbin in the direction of tightening the thread wound thereon to remove any slack therein.

According to a further feature, the axle is provided on its outer face with at least one axially-extending strip of a color distinctive from the color of the remainder of the axle, enabling optically detecting the rotation of an empty bobbin when the thread is to be automatically rewound thereon; also, the axially-extending strip is of a friction material for catching the thread when the thread is to be automatically wound thereon.

The foregoing features of the invention provide an arrangement which permits automatic detection, in a reliable and simple manner, of the condition of the bobbin thread, particularly whether a break has occurred or the thread has become exhausted. In addition, the foregoing arrangement, particularly the provision of the vanes on the bobbin end wall impinged by the air jet from the nozzle, maintains the thread relatively tight on the bobbin.

According to a further feature, there is provided sewing apparatus comprising a sewing head including a drive therefor, a bobbin for feeding thread to the sewing head, a monitoring device sensing the rotation of the bobbin and outputting a train of pulses in response thereto, and control means receiving the output of the monitoring device and effective to automatically terminate the operation of the sewing head drive upon failure to receive the train of pulses from the monitoring device; characterized in that the control means includes a time delay circuit disabling the control means from automatically terminating the operation of the sewing head drive until the elapse of a predetermined time interval after the drive has started to drive the sewing head.

Thus, failure of the bobbin to rotate would indicate either a thread-breakage condition or an end-of-thread condition. In either case, the control means is effective to automatically terminate the operation of the sewing head drive. However, if there is an initial slack in the thread before the start of the sewing head drive, this initial slack is accommodated by the mentioned time delay circuit which disables the control means from automatically terminating the operation of the sewing head drive until the elapse of a predetermined time interval after the drive has started to drive the sewing head. This predetermined time interval may be, for example, about 300 milliseconds.

According to yet another feature in the preferred embodiment of the invention described below, the control means includes a second time delay circuit disabling the control means from automatically terminating the operation of the sewing head drive until the elapse of a second predetermined time interval after the monitoring device has ceased to output a train of pulses in response to the rotation of the bobbin. This second time delay circuit accommodates any possible slack in the thread during the actual sewing operations. Its time period should be shorter than that of the first-mentioned time delay circuit. As a preferred example, the time delay of the second time delay circuit is approximately 150 milliseconds.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
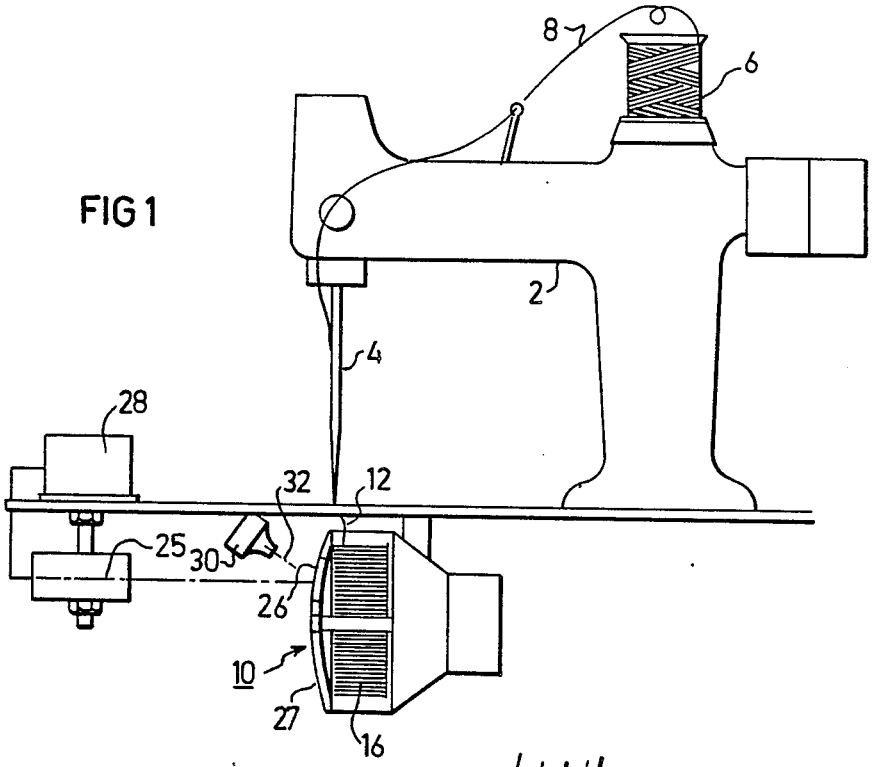
FIG. 1 is a side elevational view illustrating the main components of sewing apparatus equipped with a thread-monitoring device in accordance with the present invention.

With reference first to FIG. 1, there is illustrated a sewing machine head, generally designated 2, including a reciprocating sewing needle 4, a spool 6 for feeding an upper thread 8 to the sewing needle, and a lower-thread unit 10 for feeding the lower thread 12 to the sewing needle. The lower thread unit 10, as more particularly illustrated in FIG. 2, comprises a case 14, a bobbin 16 disposed within the case and containing a supply of the lower thread 12, and a rotary housing 18 which is rotated in synchronism with the reciprocation of the sewing needle 4, the pressure foot 20 and the other components of the sewing machine, so as to form stitches with the upper thread 8. The general construction and mode of operation of such sewing machines are well-known, and therefore further details not essential to an understanding of the present invention are not set forth herein.

According to the present invention, the lower-thread, or bobbin-thread, unit 10 is provided with a monitoring device for monitoring the bobbin thread to indicate either a broken-thread or an exhausted-thread condition. In addition, unit 10 is also provided with an arrangement for maintaining the thread relatively tight on the bobbin, and with a further arrangement for facilitating rewinding the bobbin with an additional supply of thread when the original supply has become exhausted.

Figure 2:
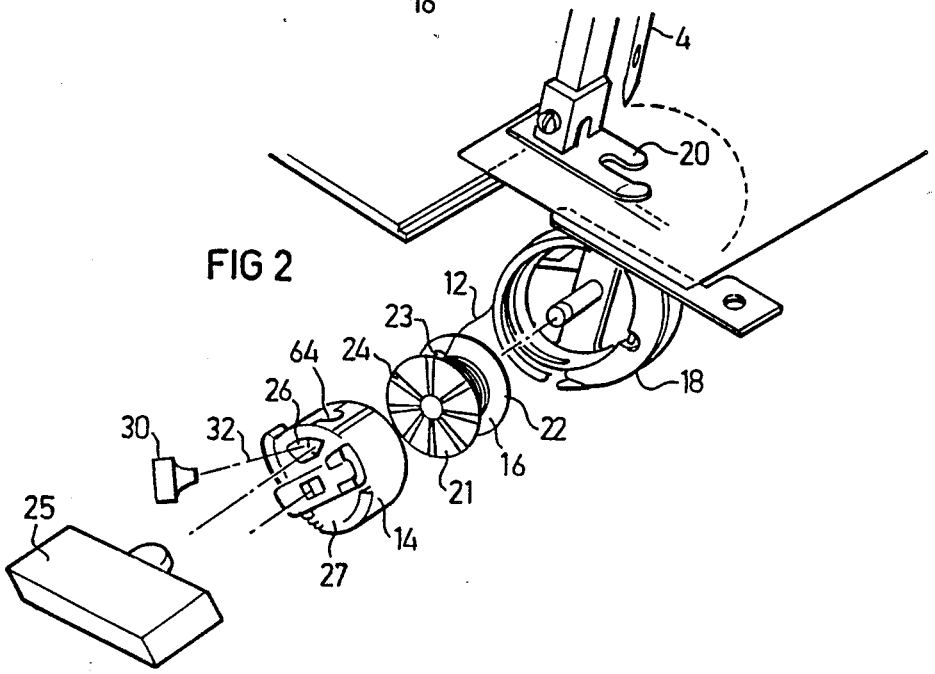
FIG. 2 is an exploded three-dimensional view illustrating the main components of the bobbin thread-monitoring device in the sewing apparatus of FIG. 1.
Figure 3:
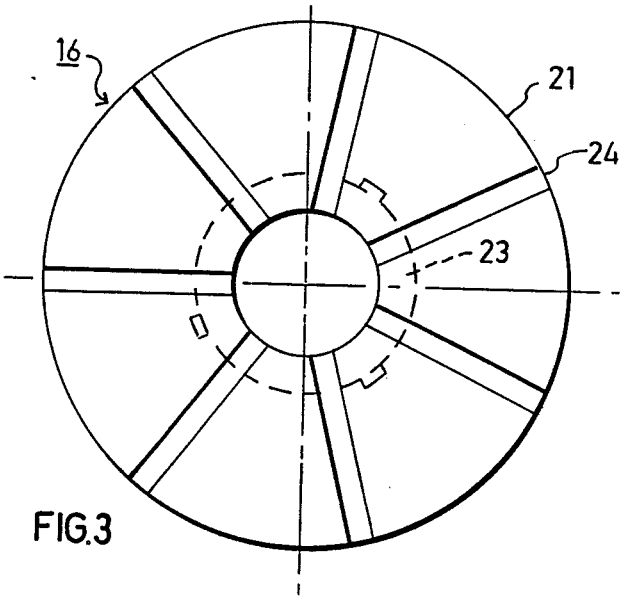
FIG. 3 is an enlarged side elevational view illustrating the end wall of the lower bobbin in the sewing apparatus of FIGS. 1 and 2.
Figure 4:
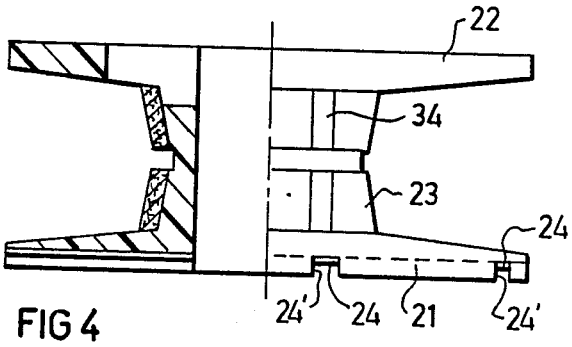
FIG. 4 is an end view, partly in section, illustrating the bobbin of FIGS. 1–3.

As shown particularly in FIGS. 2 and 4, the bobbin 16 is provided with a pair of end walls 21, 22 interconnected at their centers by an axle 23 for receiving the thread 12 wound on the axle. The outer face of one of the end walls 21 is formed with a plurality of radially-extending strips 24 of an optically-sensible material radiating from the center of the end wall. Thus, strips 24 may be of dark color (e.g., black) so as to be optically distinguishable from the lighter color (e.g., white) of the remainder of. As shown in FIG. 3, each strip 24 has a width in the circumferential direction which is a small fraction of its length in the radial direction. Strips 24 are sensed by an optical sensor 25 aligned with an opening 26 in an end wall 27 of the bobbin case 14, as shown in FIG. 2. The arrangement is such that when bobbin 16 is rotating, stripes 24 on its end wall 21 generate, in optical sensor 25, a series of pulses which thereby indicate not only the fact that the bobbin is rotating, but also its rotary velocity.

The pulses generated by optical sensor 25 are fed to a unit 28 (FIG. 1) which may include an indicator for indicating whether or not the bobbin is rotating, and/or its rotational velocity. Unit 28 may also include a control for automatically controlling the sewing machine in response to this information, e.g., for automatically stopping the sewing machine should the bobbin cease to rotate, thereby indicating either a break in the bobbin thread or the exhaustion of the bobbin thread. Control unit 28 may also be effective, upon sensing a thread-breakage or a thread-exhaustion condition, to effect the automatic withdrawal of the bobbin and its replacement with another bobbin having a full supply of thread.

As shown particularly in FIG. 4, the colored stripes 24 formed in end wall 21 of the bobbin 16 are offset from the plane of the bobbin end wall 21. In the construction illustrated in FIG. 4, they are recessed within the end wall. By this construction, stripes 24 define a plurality of radially-extending vanes, schematically indicated at 24'. These vanes are impinged by an air jet from a nozzle 30 (FIGS. 1 and 2) aligned with opening 26 in the bobbin case 14. Nozzle 30 is oriented obliquely with respect to the axis of bobbin 16 so that the air jet 32 produced thereby impinges vanes 24' and applies a force tending to rotate the bobbin in the direction for tightening the thread 12 on the bobbin and to remove any slack therein. The amount of force produced by these vanes is sufficient only to take-up the play in the thread, and not sufficient to rotate the bobbin any significant amount against the frictional resistance in the bobbin drive.

It will thus be seen that opening 26 formed in bobbin case 14 serves two functions: It permits optical sensor 25 to monitor the bobbin 16 in order to detect whether or not the bobbin is rotating and also its rotational velocity; it also permits the air jet 32 produced by nozzle 30 to impinge the face of end wall 21 of the bobbin, particularly the vanes 24' formed by the recessed colored stripes 24, in order to apply a rotary force on the bobbin tending to tighten the thread thereon.

As further shown particularly in FIG. 4, axle 23 of the bobbin is provided on its outer face with a plurality of axially-extending strips 34 of a friction material, such as sandpaper or other material having a roughened surface, for catching the thread when the thread is to be automatically wound on the bobbin. Strips 34 are of a color which is optically distinguishable from the color of the remainder of the bobbin axle 23; for example, strips 34 may be of the color black, whereas the remainder of the bobbin axle 23 may be of the color white. Strips 34 may thus be used for optically detecting the rotation of an empty bobbin when thread is to be rewound thereon.

The operation of the illustrated sewing machine will be apparent from the above description. Thus, during the normal operation of the sewing machine, bobbin 16 will be rotating as it feeds thread 12 to the sewing needle 4. This condition will be monitored by optical sensor 25 which senses, via opening 26, the radially-extending stripes 24 formed on end wall 21 of the bobbin, and which thereby produces a train of pulses at a repetition rate corresponding to the rotational velocity of the bobbin. During the normal operation of the sewing machine, nozzle 30 produces an air jet 32 which passes through opening 26 of the bobbin case 14 and impinges against the recessed vanes 24' formed in the outer face of the bobbin end wall 21 so as to apply a rotational force tending to tighten the thread on the bobbin and to remove any slack.

Should a break occur in the bobbin thread 12, or should the thread become exhausted, bobbin 16 will no longer rotate, and therefore the optical sensor 25 will cease to produce a train of pulses. This is detected by unit 28, which unit will indicate this condition and/or effect an automatic operation of the sewing apparatus, such as stopping it to permit either manual replacement of another bobbin containing a fresh supply of thread, or automatic reloading of the apparatus with another bobbin.

The axially-extending strips 34 formed on the bobbin axle 23 serve two functions when thread is to be automatically rewound on the bobbin, of detecting the rotation of an empty bobbin, and also of catching the thread to be automatically wound on the bobbin. Such functions are particularly significant in an automatic system wherein, upon detecting an empty bobbin or one in which the thread has been broken, a control unit, indicated schematically at 28 in FIG. 1 and controlled by an optical sensor (not shown), automatically replaces the bobbin with a fresh bobbin containing a supply of thread, and also automatically rewinds the replaced bobbin with a fresh supply of thread. One system that may be used for accomplishing the above functions is described in our companion U.S. Pat. Application No. 07/235148, but it will be appreciated that the novel bobbin construction of the present application can be used in other automatic sewing systems, or even in non-automatic systems wherein, upon receiving an indication that the bobbin 16 is no longer rotating, the bobbin is manually removed and manually rewound.

Figure 5:
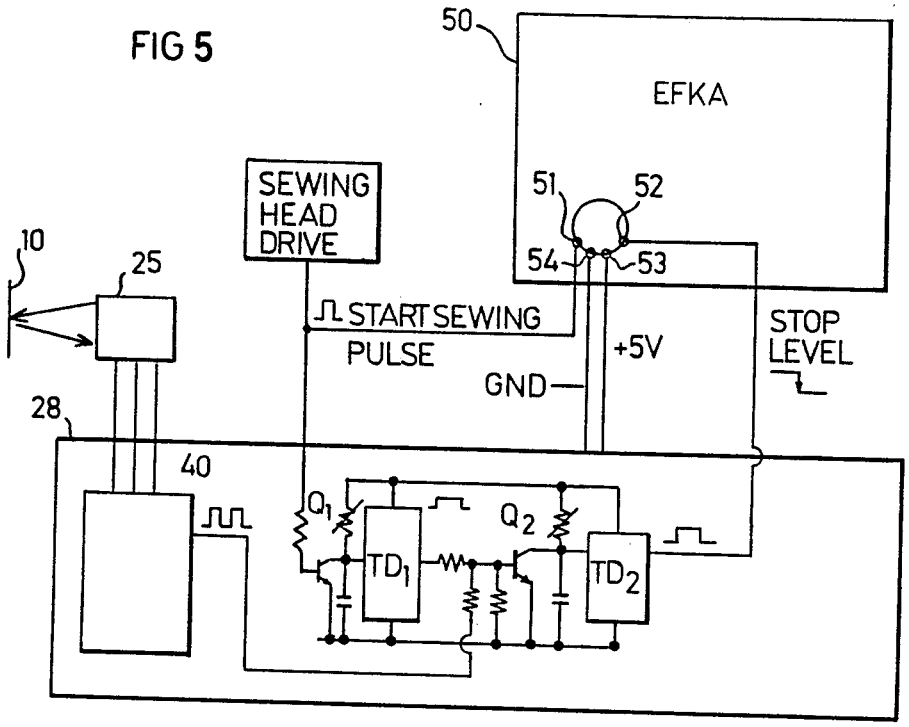
FIG. 5 is a block diagram illustrating one form of control system constructed in accordance with the invention for controlling sewing apparatus.

The system illustrated in FIG. 5 is particularly useful with respect to the lower bobbin thread monitoring system illustrated in FIGS. 1–4. Such a system includes a monitoring device, designated 25 in FIG. 5 in the form of an optical sensor which senses the rotation of the lower bobbin and output a train of pulses in response to its rotation. Thus, failure of the monitoring device 25 to output a train of pulses indicates that the bobbin is not rotating, which in turn indicates either a thread-breakage condition or an end-of-thread condition, either of which conditions is to automatically terminate the operation of the sewing head drive.

The system illustrated in FIG. 5 further includes a control system, generally designated 28, which receives the output of the monitoring device 25 and is effective to automatically terminate the operation of the sewing head drive upon failure to receive the train of pulses from the monitoring device 25. Control system 28 includes a signal processor 40 receiving the train of pulses from the monitoring device 25. Signal processor 40 processes the train of pulses to remove noise, to amplify them, and to shape them into square waves, so that so long as the monitoring device 25 outputs a train of pulses during the rotation of the bobbin, the signal processor 40 will output a corresponding train of square waves derived from the pulses outputted from the monitoring device.

The control system 28 further includes two time delay circuits $TD_1$, and $TD_2$, each controlled by a transistor $Q_1$, $Q_2$, respectively. Thus, transistor $Q_1$ starts time delay circuit $TD_1$, and transistor $Q_2$ starts time delay circuit $TD_2$.

The system illustrated in FIG. 5 further includes a controller, generated designated 50, which controls the overall operation of the sewing apparatus. Such controllers are well-known, and therefore details of its construction are not illustrated, except its ports 51, 52, 53 and 54, which are involved in the overall operation of the apparatus as controlled by the control system 28.

Thus, port 51 outputs a "start pulse" accompanying the starting of the sewing head drive. This "start pulse" from port 51 may originate from a number of different sources, for example from the controller itself, from the foot pedal switch which starts a sewing operation, from the sewing head synchronizer, or from the upper thread breakage monitor; none of these is illustrated in the accompanying drawings for purposes of simplifying the description.

Port 52 of the controller 50 is connected to receive the "stop pulse" from the control system 28, particularly from its second time delay circuit $TD_2$, when the operation of the sewing head drive is to be automatically terminated upon failure of the lower bobbin to rotate, as detected by the monitoring device 25.

Ports 53 and 54 of controller 50 are merely connected to +5 volts and ground, respectively.

Port 51 which outputs the "start pulse", is connected to transistor $Q_1$ to start the time delay circuit $TD_1$ immediately upon receiving the start pulse. Upon the elapse of the time interval ($t_1$) of that circuit, a pulse is outputted to transistor $Q_2$ of the second time delay circuit $TD_2$. Transistor $Q_2$ also receives the train of pulses from the signal processor 40. Thus, the second time delay circuit $TD_2$ is initiated to start timing only after the lapse of the predetermined time interval ($t_2$) of time delay circuit $TD_1$. The train of pulses from signal processor 40, as originally derived from the monitoring device 25 in response to the rotation of the bobbin, are effective to restart the predetermined time interval of time delay circuit $TD_2$ with each of the pulses received from the signal processor.

Thus, after receiving the initial "start pulse", the "stop pulse" from time delay circuit $TD_2$ will not be outputted until the elapse of times $t_1+t_2$, but during a sewing operation, a "stop pulse" will be outputted only the elapse of the time interval $t_2$ after the lower bobbin has ceased to rotate, thereby indicating a thread-breakage or an end-of-thread condition.

Figure 6:
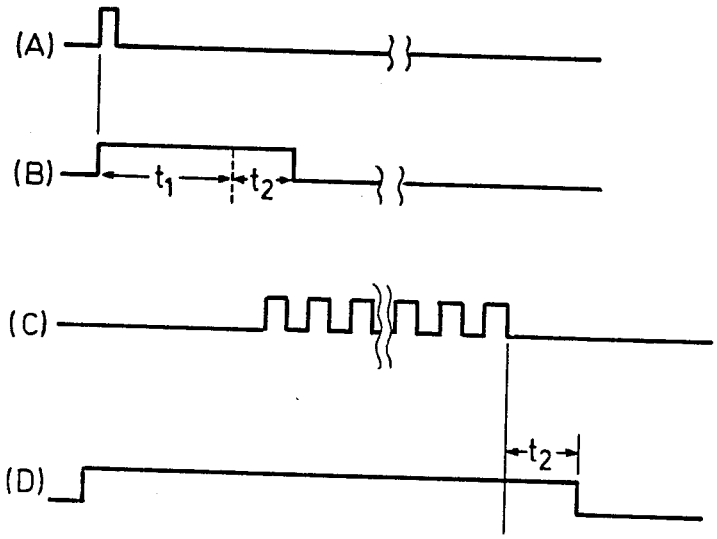
FIG. 6 is a timing diagram helpful in understanding the operation of the system of FIG. 1.

The overall operation of the system illustrated in FIG. 5 will be better understood by the timing diagram illustrated in FIG. 6.

Thus, when the sewing head drive is actuated to drive the sewing needle, a "start pulse" is outputted (waveform A) from port 51 of controller 50 to transistor $Q_1$ which starts the timing device $TD_1$. As indicated earlier, this "start pulse" may be produced by the controller, foot pedal switch, sewing head synchronizer, upper-thread breakage monitor, or in any other manner so as to accompany the actuation of the sewing head drive.

As soon as transistor $Q_1$ receives the "start pulse", timer $TD_1$ starts to operate, and after a predetermined time interval ($t_1$, e.g., 300 milliseconds) it actuates transistor $Q_2$ to start timer $TD_2$; thus, the output from the latter timer is a pulse equal to $t_1+t_2$ (waveform B).

Normally, during this time interval of $t_1+t_2$, the lower bobbin will start to rotate, to output a train of pulses as detected by monitoring device 25 (waveform C). These pulses are also applied to transistor $Q_2$, which transistor retriggers time delay $TD_2$, thereby restarting it to the beginning of its predetermined time interval. Accordingly, so long as these pulses are applied to transistor $Q_2$ from monitoring device 25, within time $t_1+t_2$ at the start, and within time $t_2$ thereafter, time delay circuit $TD_2$ will never run out, and therefore no "stop" pulse will be produced.

Such a "stop" pulse will therefore be produced from time delay circuit $TD_2$ to terminate the operation of the sewing head drive under the following circumstances:

(a) at the start of a sewing operation when the sewing head drive is first actuated, if times $t_1+t_2$ run out before a pulse is received from the monitor device 25 (via signal processor 28) indicated that the bobbin has started to rotate. This time delay (e.g., 300 milliseconds) is effective to permit the system to take-up the initial slack in the thread before enabling the monitoring device to terminate the operation of the sewing head drive when the bobbin does not rotate indicating a thread-breakage or an end-of-thread condition; and (b) during a sewing operation, if time $t_2$ runs out before a pulse is received from the monitoring device 25, this time delay (e.g., 150 milliseconds) being effective to accommodate any slack in the thread during a sewing operation.

While the invention has been described with respect to one preferred embodiment, it will be appreciated that many other variations, modifications and applications of the invention may be made.

What is claimed is:

1. A sewing machine bobbin comprising a pair of end walls interconnected at their centers by an axle for receiving thread wound on the axle; characterized in that the outer face of one of said end walls is formed with a plurality of radially-extending strips of an optically-sensible material radiating from the center of the end wall, each of said radially-extending strips of optically-sensible material having a width in the circumferential direction which is a small fraction of its length in the radial direction, whereby said radially-extending strips provide sensible markings enabling the optical detection of the non-rotation of the bobbin during a sewing operation, thereby indicating a break in, or the exhaustion of, the thread wound on the bobbin.

2. The bobbin according to claim 1, wherein said radially-extending strips are offset from the plane of the bobbin end wall to define a plurality of radially-extending vanes for impingement by an air jet from a nozzle oriented to apply a rotary force to the bobbin in the direction of tightening the thread wound thereon.

3. The bobbin according to claim 2, wherein said radially-extending strips are recessed with respect to the plane of the bobbin end wall.

4. The bobbin according to claim 1, wherein said axle is provided on its outer face with at least one axially-extending strip of a color distinctive from the color of the remainder of the axle, enabling optically detecting the rotation of an empty bobbin when the thread is to be automatically rewound thereon.

5. The bobbin according to claim 4, wherein said axially-extending strip is of a friction material for catching the thread when the thread is to be automatically wound thereon.

6. Sewing apparatus comprising a bobbin according to claim 1, and an optical sensor for optically sensing said radially-extending strips and for producing a train of pulses during the rotation of the bobbin, such that the termination of the train of pulses by the non-rotation of the bobbin indicates a break in, or the exhaustion of, the thread wound on the bobbin.

7. Sewing apparatus comprising a bobbin according to claim 2, and a nozzle located to discharge a jet of air against said radially-extending vanes and thereby to apply a rotary force to the bobbin in the direction of tightening the thread wound thereon.

8. Sewing apparatus comprising a bobbin according to claim 4, and an optical sensor for optically sensing the rotation of an empty bobbin when the thread is to be automatically wound thereon.

9. Sewing apparatus comprising a sewing head including a drive therefor, a bobbin for feeding thread to the sewing head, a monitoring device sensing the rotation of the bobbin and outputting a train of pulses in response thereto, and control means receiving the output of said monitoring device and effective to automatically terminate the operation of the sewing head drive upon failure to receive the train of pulses from the monitoring device; characterized in that said control means includes a first time delay circuit disabling the control means from automatically terminating the operation of the sewing head drive until the elapse of a first predetermined time interval after said drive has started to drive the sewing head, and a second time delay circuit disabling the control means from automatically terminating the operation of the sewing head drive until the elapse of a second predetermined time interval after said monitoring device has ceased to output a train of pulses in response to the rotation of the bobbin.

10. The sewing apparatus according to claim 9, wherein said first time delay circuit outputs a pulse to said second time delay circuit to initiate its time delay after the elapse of the predetermined time interval of the first-mentioned time delay circuit.

11. The sewing apparatus according to claim 10, wherein said train of pulses from the monitoring device are fed to said second time delay circuit such that each of said pulses is effective to trigger it to restart the, predetermined time interval thereof.

12. The sewing apparatus according to claim 10, wherein said first-mentioned time delay circuit is started upon the reception of a start pulse accompanying the starting of the sewing head drive.

13. The sewing apparatus according to claim 9, wherein said first time delay is about 300 milliseconds.

14. The sewing apparatus according to claim 9, wherein said second time delay is about 150 milliseconds.

15. The sewing apparatus according to claim 9, wherein said monitoring device includes an optical sensor sensing the rotation of the bobbin.

16. The sewing apparatus according to claim 9, wherein said bobbin is the lower thread bobbin feeding the lower thread to the sewing head.

* * * * *

UNITED STATES PATENT AND TRADEMARK OFFICE

CERTIFICATE OF CORRECTION

PATENT NO. : 4,934,292

DATED : June 19, 1990

INVENTOR(S) : Mardix et al.

It is certified that error appears in the above-indentified patent and that said Letters Patent is hereby corrected as shown below:

| | |
|---|---|
| Title Page | Column 1, add:<br>(30) Foreign Application priority data<br>(1) October 2, 1987 (IL) Israel 84073<br>(2) July 8, 1988 (IL) Israel 87031 |
| Column 3 | Line 63, after "of" there should be added --end wall 21--. |

Signed and Sealed this

Eighth Day of March, 1994

*Attest:*

*Attesting Officer*

BRUCE LEHMAN

*Commissioner of Patents and Trademarks*